US006637365B1

(12) United States Patent
Adamski

(10) Patent No.: US 6,637,365 B1
(45) Date of Patent: Oct. 28, 2003

(54) CAR LOCATING DEVICE WITH INTERCHANGEABLE INDICIA

(76) Inventor: Raymond T. Adamski, 1806 Ellinwood Rd., Baltimore, MD (US) 21237

( * ) Notice: Subject to any disclaimer, the term of this patent is extended or adjusted under 35 U.S.C. 154(b) by 0 days.

(21) Appl. No.: 10/085,260

(22) Filed: Feb. 28, 2002

(51) Int. Cl.[7] ..... G09F 7/00
(52) U.S. Cl. ..... 116/28 R; 116/173
(58) Field of Search ..... 116/28 R, 173, 116/174; 40/591, 592

(56) References Cited

U.S. PATENT DOCUMENTS

| | | | | | |
|---|---|---|---|---|---|
| 1,595,395 | A | | 8/1926 | Herbener | 116/173 |
| 3,148,856 | A | * | 9/1964 | Orlando | 248/205.6 |
| 3,280,790 | A | | 10/1966 | Booth | 116/173 |
| 4,163,426 | A | * | 8/1979 | O'Neill | 116/28 R |
| 4,583,310 | A | * | 4/1986 | Seiler | 40/592 |
| 4,727,822 | A | * | 3/1988 | Wikkerink | 116/174 |
| 4,976,410 | A | | 12/1990 | Tomaiuolo | 248/514 |
| 4,986,209 | A | * | 1/1991 | Spica | 116/28 R |
| 5,233,938 | A | | 8/1993 | Lalo | 116/173 |
| 5,253,608 | A | * | 10/1993 | Burke | 116/173 |
| 5,279,250 | A | * | 1/1994 | Palermo et al. | 116/174 |
| 5,299,525 | A | | 4/1994 | Romesburg | 116/173 |
| 5,363,792 | A | * | 11/1994 | Petechik | 116/28 R |
| 5,495,821 | A | | 3/1996 | Brewer | 116/174 |
| 5,572,835 | A | * | 11/1996 | Atkins et al. | 52/111 |
| 6,010,107 | A | * | 1/2000 | Goldfarb | 248/512 |
| 6,129,035 | A | | 10/2000 | Schweinberger | 116/28 R |

* cited by examiner

*Primary Examiner*—Diego Gutierrez
*Assistant Examiner*—R. Alexander Smith
(74) *Attorney, Agent, or Firm*—Sturm & Fix LLP

(57) ABSTRACT

A vehicle locator (10) for assisting drivers in locating their personal vehicle (100) in a crowded parking lot. The device (10) includes a visual indicator indicia unit (13) comprising a plurality of colored pennant members (50) (50') etc., having colors selected from among different colors and/or shades of the same color to customize the visual recognition pattern of the colored pennants (50) (50') which are mounted on a hollow support column member (40) rotatably disposed around a shaft (30). At least one spring element (45) being located between the hollow support column member and the shaft in order to center the hollow support column member around the shaft.

8 Claims, 3 Drawing Sheets

Fig. 1
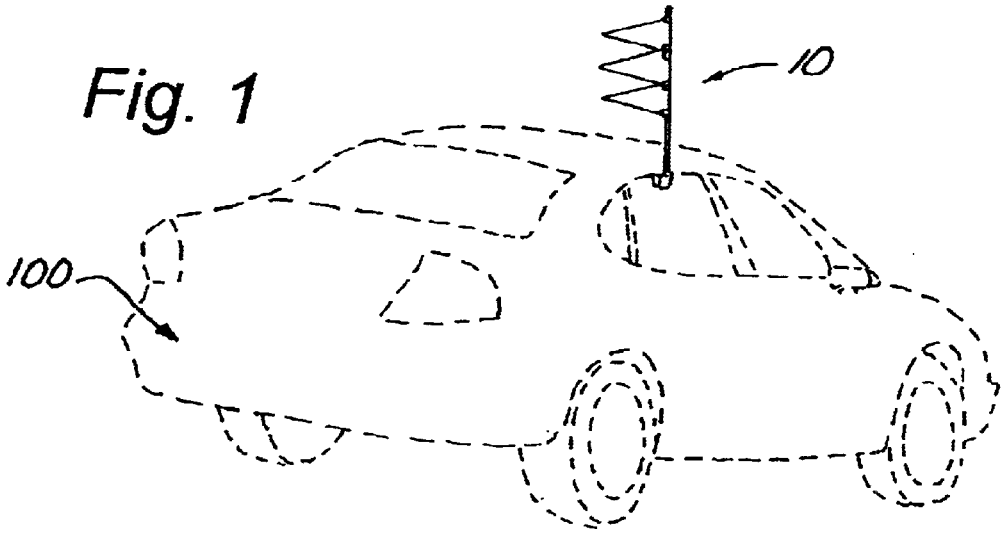
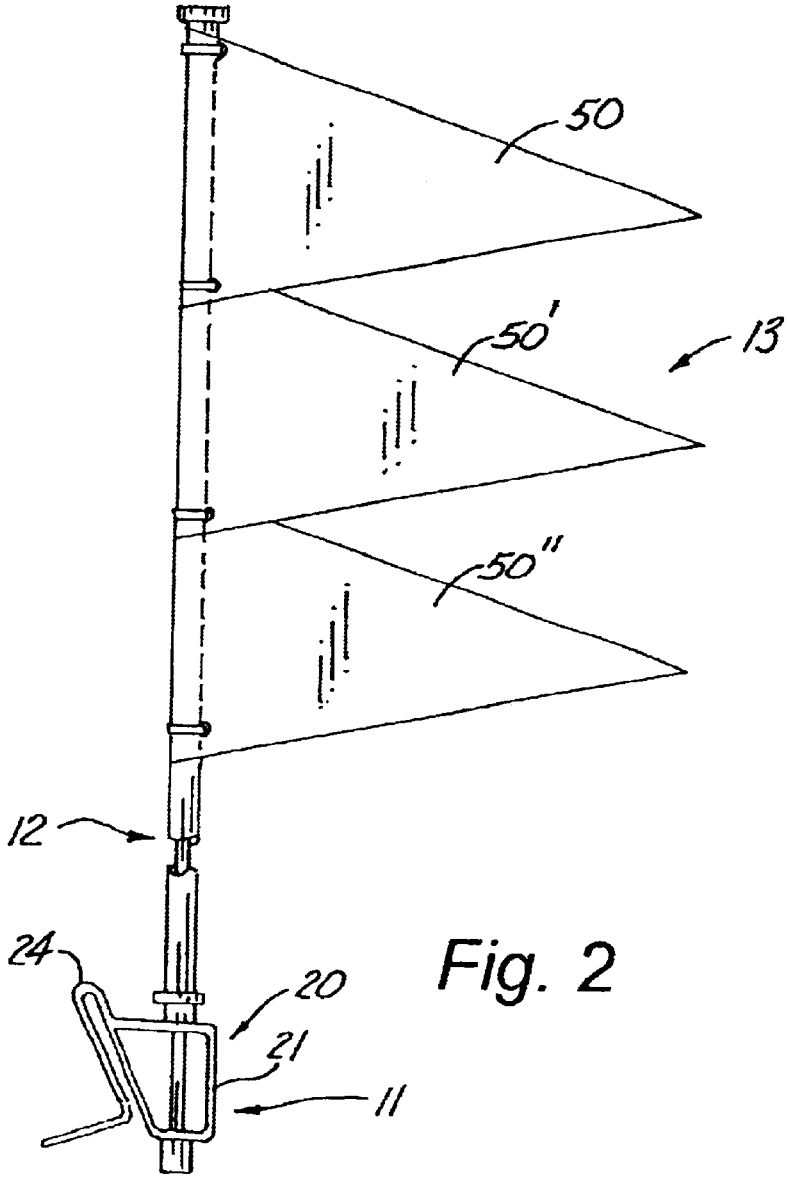
Fig. 2

CAR LOCATING DEVICE WITH INTERCHANGEABLE INDICIA

CROSS REFERENCE TO RELATED APPLICATIONS

Not applicable.

BACKGROUND OF THE INVENTION

1. Field of the Invention

The present invention relates to the field of devices employed to assist drivers in locating their vehicle in a crowded parking lot in general, and in particular to such a device employing multiple interchangeable indicia and a reinforced rotatable support column.

2. Description of Related Art

As can be seen by reference to the following U.S. Pat. Nos. 4,986,209; 5,495,821; 5,233,938; 1,595,395; and 5,299,525, the prior art is replete with myriad and diverse car locating devices employing some type of indicia.

While all of the aforementioned prior art constructions are more than adequate for the basic purpose and function for which they have been specifically designed, they are uniformly deficient with respect to their failure to provide a simple, efficient, and practical car locating device having interchangeable indicia that can be customized to reflect a person's favorite colors in a particular sequence to minimize the possibility that someone else will employ the same color combination to identify their own vehicle.

As a consequence of the foregoing situation, there has existed a longstanding need among car owners for a new and improved car locating device that employs interchangeable visual indicia on a unique support system mounted on a base member that clips onto a vehicle window, and the provision of such a construction is a stated objective of the present invention.

BRIEF SUMMARY OF THE INVENTION

Briefly stated, the car locating device that forms the basis of the present invention comprises in general a mounting unit, a support unit, and a visual indicator unit operatively associated with the support unit wherein the mounting unit is adapted to releasably receive the upper portion of a vehicle window.

As will be explained in greater detail further on in the specification, the mounting unit comprises a contoured base member including a base element formed integrally with a contoured clip element and defining an elongated angled slot that is dimensioned to receive a portion of a vehicle window.

The support unit includes both an elongated support shaft member that is operatively connected to the mounting unit; and an elongated support column member that is disposed in a rotatable relationship relative to the elongated support shaft member.

In addition, the visual indicator unit includes a plurality of colored pennant members which are adapted to be releasably secured to the elongated support column member; wherein, the colors of the pennants are selectively chosen by each driver from different colors and shades of the same color to provide a unique customized color recognition pattern for each driver from among a vast number of potential color choices, as well as the particular sequence in which the colored pennants are displayed on the external support column member.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein:

FIG. 1 is a perspective view of the car locator device installed on a vehicle;

FIG. 2 is an isolated perspective view of the car locator device;

DETAILED DESCRIPTION OF THE INVENTION

Figure 3:
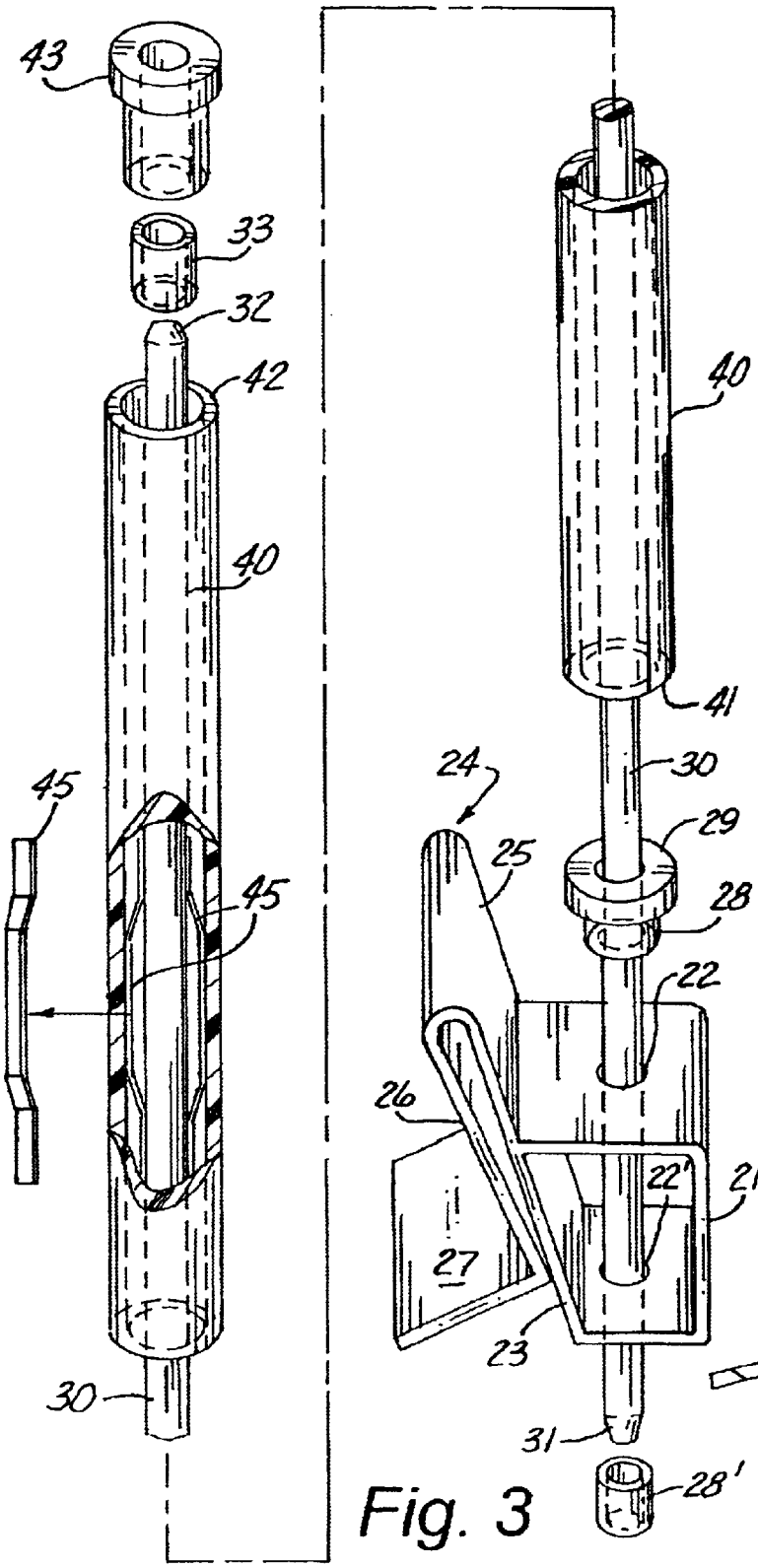
FIG. 3 is an exploded perspective view of the lower portion of the device and a partial cross-sectional of the upper portion of the device.

As can be seen by reference to the drawings, and in particular to FIGS. 1 and 2, the car locator device that forms the basis of the present invention is designated generally by the reference number 10. The device 10 comprises in general a mounting unit 11, a support unit 12 and a visual indicator unit 13. These units will now be described in seriatim fashion.

Figure 4:
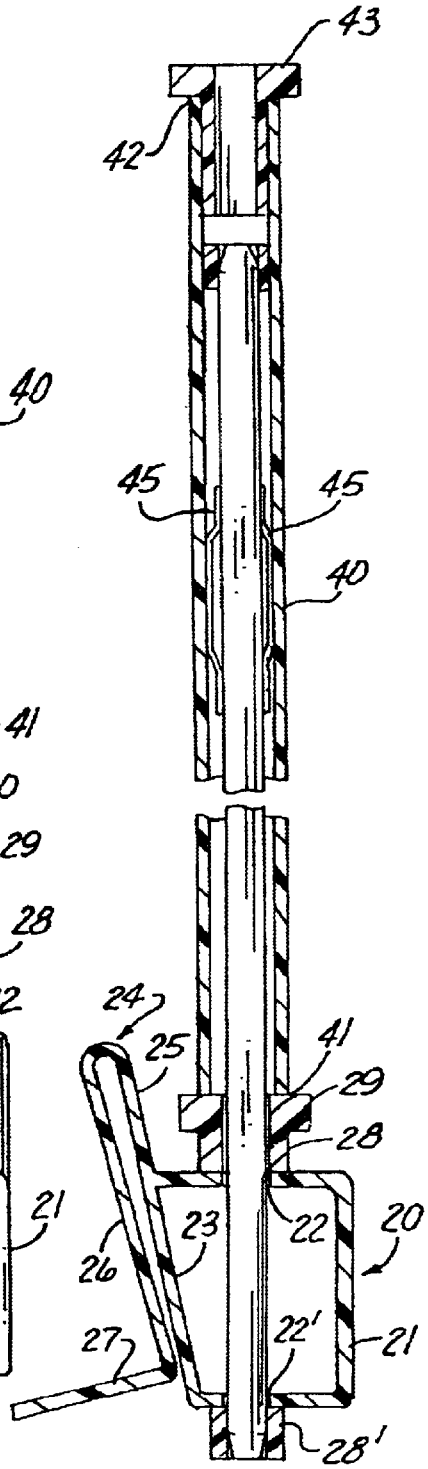
FIG. 4 is a cross-sectional view of the device.
Figure 5:
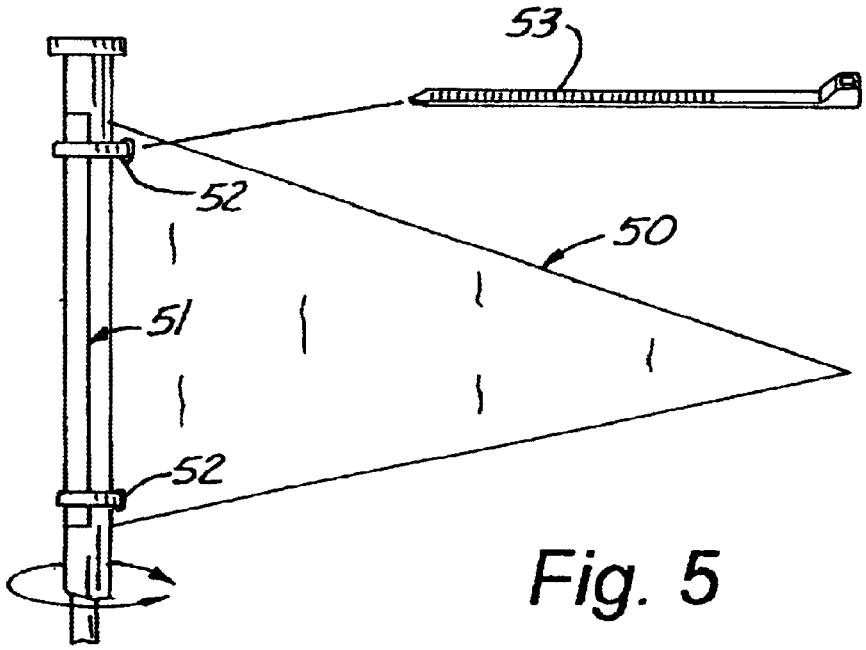
FIG. 5 is an isolated detail view of the method employed in attaching a single pennant to the device; and, FIG. 6 is a side elevation view of a plurality of different colored pennants that may be employed to personalize the visual impact to the car locator device.
Figure 6:
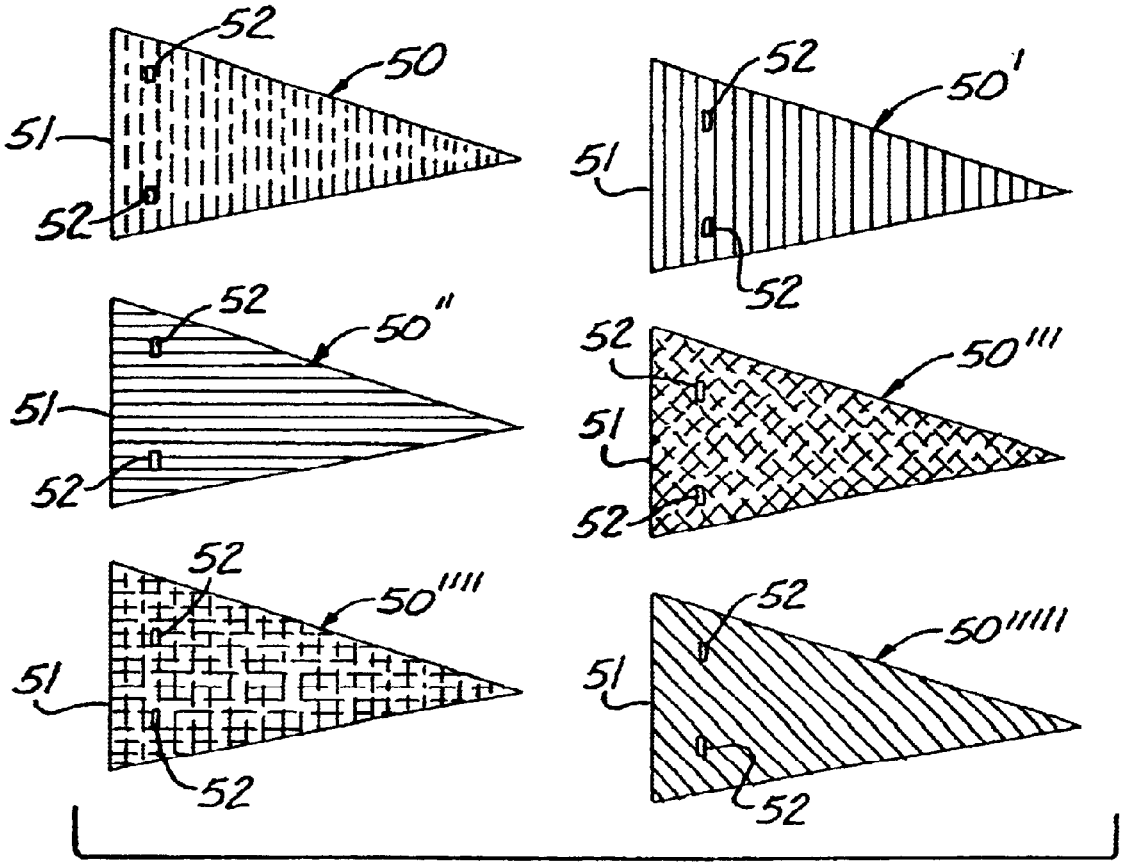

As shown in FIGS. 3 and 4, the mounting unit 11 comprises a contoured base member 20 including a generally trapezoidal hollow base element 21 having a pair of vertically aligned apertures 22 22' formed therein and further provided with an angled rear wall 23 formed co-extensive and integrally with a contoured clip element designated generally as 24.

In addition, the clip element 24 has a quasi S-shaped configuration. The upper portion 25 of the clip element 24 has a narrow inverted U-shaped configuration and the lower portion 26 of the clip element 24 has a generally L-shaped configuration which terminates in an elongated outwardly projecting grasping lip 27 which is disposed generally perpendicular to the angled rear wall 23 of the base element 21. The leg of the U-shaped lower portion 25 and the leg of the L-shaped lower portion 26 of the clip element 24 are disposed generally parallel to the angled rear wall 23 of the base element 21 to form a slot that is dimensioned to receive the upper edge of a vehicle window 101 in a well recognized fashion.

Furthermore, both the exterior surfaces of the top and bottom of the base element 21 are provided with collar elements 28 28' disposed in a surrounding relationship relative to the opposed vertical aligned apertures 22 22' wherein the upper collar element 28 is further provided with an outwardly projecting lip portion 29 whose purpose and function will be described presently.

Still referring to FIGS. 3 and 4, it can be seen that the support unit 12 comprises in general an elongated internal support shaft member 30 whose lower end 31 is dimensioned to pass through the aligned apertures 22 22' in the base element 21 and be captively engaged in the lower collar element 28', and the upper end 32 of which is adapted to be captively engaged in a hollow cylindrical plug element 33.

In addition, the support unit 12 further comprises an external hollow support column member 40 disposed in a surrounding relationship relative to the support shaft member 30 wherein the lower end 41 of the support column member 40 is rotatably supported by the outwardly projecting lip portion 29 of the upper collar element 28 of the base member 20 and the upper end 42 of the support column member 40 is to receive a stepped shoulder cap element 43.

Furthermore, as shown in FIGS. 3 and 4, the support unit 12 also includes a plurality of spring bearing elements that are disposed intermediate the opposed sides of the shaft member 30 and the column member 40 to center the shaft member 30 relative to the column member 40 and allow the column member 40 to be raised and lowered relative to the shaft member 30.

As can best be appreciated by reference to FIGS. 1, 2, 5 and 6, the visual indicator unit 13 comprises a plurality of individual generally triangular shaped pennant members 50 fabricated from flourescent material and each having an enlarged base 51 and a pair of apertures laterally offset from the base 51 wherein each of the apertures 52 is dimensioned to receive a securing element 53 that will pass through a selected one of the apertures in at least one of the pennant members 50.

As was mentioned previously, in addition to the unique construction of the support unit 12, the plurality of pennant members 50 50' etc., is intended to be produced in both different colors and different shades of the same color thereby allowing the user to choose not only their own preferred colors and/or shades of color, but the position of the selected colors of the pennants relative to the external support column member 40 offers a virtually infinite number of combinations of different colors and shades which may be made available to each individual to customize their pennant recognition indicia as an aid to locating their vehicle 100 in a crowded parking lot.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A vehicle locator device to assist a driver in locating their vehicle in a crowded parking lot wherein the device comprises:

a mounting unit including a contoured base member having a base element and a clip element that define an elongated slot dimensioned to receive the upper portion of a vehicle window;

a support unit including an elongated support shaft member having a lower end connected to said base element and a hollow support column member disposed in a surrounding relationship relative to the support shaft member; wherein the hollow support column member is rotatable relative to the support shaft member; and the support unit further includes at least one spring element disposed intermediate the shaft member and the support column member and, a visual indicator unit including a plurality of colored pennant members releasably secured to a portion of the support column member wherein the particular color of each pennant member is selected from among a plurality of different colors and/or shades of the same color.

2. The device as in claim 1; wherein, said base element has an angled rear wall formed integrally and co-extensive with a portion of said clip element.

3. The device as in claim 2; wherein, said clip element includes an upper portion having a narrow inverted U-shaped configuration dimensioned to receive a portion of a vehicle window.

4. The device as in claim 3; wherein, said clip element further includes a lower portion formed integrally with said upper portion and having a generally L-shaped configuration.

5. The device as in claim 4; wherein, the lower portion of the clip element terminates in a generally flat outwardly projecting grasping lip.

6. The device as in claim 1; wherein, the base element is provided with pair of vertically aligned apertures dimensioned to receive the lower end of the support shaft members.

7. The device as in claim 6; wherein, the top surface of the base element is further provided with a hollow collar element disposed in a surrounding relationship relative to one of the pair of vertically aligned apertures.

8. The device as in claim 7; wherein, the support column member has a lower end adapted to rest upon the hollow collar element.

* * * * *